US005865041A

United States Patent [19]

Agrawal et al.

[11] Patent Number: 5,865,041

[45] Date of Patent: Feb. 2, 1999

[54] DISTILLATION PROCESS USING A MIXING COLUMN TO PRODUCE AT LEAST TWO OXYGEN-RICH GASEOUS STREAMS HAVING DIFFERENT OXYGEN PURITIES

[75] Inventors: Rakesh Agrawal, Emmaus; Donn Michael Herron, Fogelsville; Stephen John Cook, Macungie, all of Pa.

[73] Assignee: Air Products and Chemicals, Inc., Allentown, Pa.

[21] Appl. No.: 71,481

[22] Filed: May 1, 1998

[51] Int. Cl.[6] ..... F25J 3/04

[52] U.S. Cl. ..... 62/643; 62/649; 62/654

[58] Field of Search ..... 62/643, 649, 654, 62/646

[56] References Cited

U.S. PATENT DOCUMENTS

| | | | |
|---|---|---|---|
| 4,022,030 | 5/1977 | Brugerolle . | |
| 4,717,409 | 1/1988 | Atkinson | 62/651 |
| 4,747,860 | 5/1988 | Atkinson | 62/654 X |
| 4,883,517 | 11/1989 | Rathbone | 62/654 |
| 4,916,908 | 4/1990 | Lavin et al. | 62/645 |
| 5,291,737 | 3/1994 | Camberlein et al. . | |
| 5,315,833 | 5/1994 | Ha et al. . | |
| 5,396,773 | 3/1995 | Ha et al. . | |
| 5,454,227 | 10/1995 | Straub et al. . | |
| 5,490,391 | 2/1996 | Hogg et al. | 62/646 |
| 5,551,258 | 9/1996 | Rathbone | 62/646 |
| 5,704,228 | 1/1998 | Tranier | 62/643 |
| 5,778,700 | 7/1998 | Lee et al. | 62/656 |

FOREIGN PATENT DOCUMENTS

| | | |
|---|---|---|
| 0636845 | 3/1995 | European Pat. Off. . |
| 0793069 | 3/1997 | European Pat. Off. . |

*Primary Examiner*—Christopher B. Kilner
*Attorney, Agent, or Firm*—Robert J. Wolff

[57] ABSTRACT

A process is set forth for the cryogenic distillation of an air feed to produce at least two oxygen-rich gaseous streams having different oxygen purities. The process uses a mixing column system in addition to a distillation column system. A key to the process is that at least two oxygen-rich liquid streams having different oxygen purities are transferred from the distillation column system to the mixing column system in order to produce the oxygen-rich gaseous streams.

16 Claims, 5 Drawing Sheets

DISTILLATION PROCESS USING A MIXING COLUMN TO PRODUCE AT LEAST TWO OXYGEN-RICH GASEOUS STREAMS HAVING DIFFERENT OXYGEN PURITIES

BACKGROUND OF THE INVENTION

The present invention relates to a process for the cryogenic distillation of an air feed. As used herein, the term "air feed" generally means atmospheric air but also includes any gas mixture containing at least nitrogen and oxygen.

There is a need in the chemicals industry for oxygen-rich gas at elevated pressure and at varying purity, ranging from moderate purity gas comprised of 97 mole % or less of oxygen to high purity gas comprised of 97 mole % or greater of oxygen, preferably 99 mole % or greater of oxygen. Some applications may also require oxygen at two different purities and at elevated pressure.

The objective of the present invention is a cryogenic process that produces at least two different oxygen-rich gaseous products at differing purities and that produces at least two of these oxygen-rich gaseous products from a mixing column system, optionally at elevated pressure if desired.

U.S. Pat. Nos. 5,315,833 and 5,396,773 assigned to Liquid Air Engineering Corp. describe a double column air separation process in which two oxygen-rich products of differing purities are produced from a double column assembly. Multiple reboilers are included in the lower pressure column of the assembly to permit more efficient production of two products. This process does not use a mixing column to produce elevated pressure products and so requires feed air to the process to be compressed to a high pressure (the pumped liquid oxygen arrangement). This negatively impacts the energy consumption of the process.

European Patent Application Number 96301423.8 assigned to Air Products and Chemicals, Inc. describes a triple column process in which a double column apparatus is supplemented with a third column to permit the production of a second oxygen-rich product of high purity. This process does not employ a mixing column and so requires feed air to be compressed to a high pressure (the pumped liquid oxygen arrangement), negatively impacting the energy consumption of the process.

U.S. Pat. Nos. 4,022,030 and 5,291,737 assigned to L'Air Liquide and European Patent Application Number 94302954.6 assigned to The BOC Group plc describe processes in which a mixing column is used to produce a single oxygen-rich gaseous product. Although these L'Air Liquide patents describe a process by which multiple purity oxygen-rich products could be produced, only one of the products is produced directly from a mixing column. Likewise, the BOC patent application teaches a mixing column process for the production of a single oxygen-rich gaseous product only. These processes all teach that liquid oxygen be supplied to the mixing column as a single purity stream.

U.S. Pat. No. 5,454,227, assigned to The BOC Group, describes a process in which a single oxygen-rich gaseous product is produced from a mixing column. This process uses a turboexpanded air stream to supply vapor to the bottom of the mixing column, and would typically be more suitable for production of lower pressure oxygen-rich products than the processes of U.S. Pat. Nos. 4,022,030 and 5,291,737. U.S. Pat. No. 5,454,227 also teaches the production of a single oxygen-rich gaseous product through the use of a mixing column that is supplied with a single purity stream of liquid oxygen.

U.S. Pat. No. 5,704,228 assigned to L'Air Liquide teaches the use of a mixing column having a reboiler in its sump but does not teach the production of dual purity oxygen-rich products, nor does it teach the withdrawal of dual purity oxygen-rich liquid streams from the distillation column system.

BRIEF SUMMARY OF THE INVENTION

The present invention is a process for the cryogenic distillation of an air feed to produce at least two oxygen-rich gaseous streams having different oxygen purities. The process uses a mixing column system in addition to a distillation column system. A key to the process is that at least two oxygen-rich liquid streams having different oxygen purities are transferred from the distillation column system to the mixing column system in order to produce the oxygen-rich gaseous streams.

DETAILED DESCRIPTION OF THE INVENTION

Figure 1:
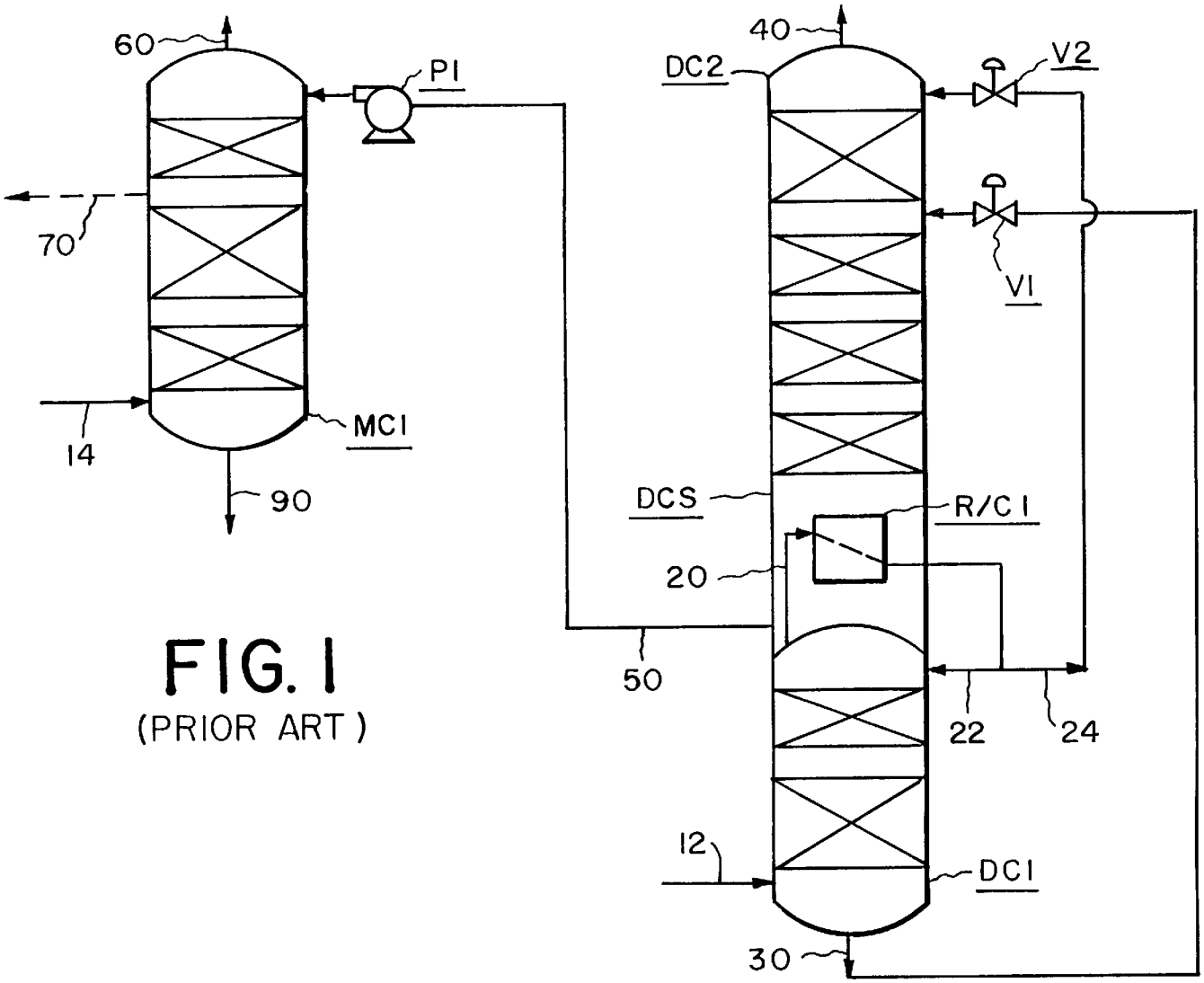
FIG. 1 (PRIOR ART)
FIG. 1 is a schematic drawing of a prior art process which uses a mixing column to produce a single oxygen-rich gaseous stream.

Prior art processes that include a mixing column are designed such that a single liquid stream is withdrawn from a distillation column system comprised of one or more distillation columns. The single liquid stream is then used as reflux for a mixing column. Vapor is supplied to the mixing column in the form of a gaseous stream comprised of air components. This stream is most typically a stream of gaseous air that has been withdrawn from the main air compressor or a turboexpander. An example diagram of such a prior art process is shown in FIG. 1. Referring now to FIG. 1, a liquid stream [50], typically enriched in oxygen, is withdrawn from a distillation column system [DCS] and fed to a mixing column [MC1]. If the desired delivery pressure of the oxygen-rich product gas [60] is higher than the pressure of this liquid stream, the liquid stream is appropriately pumped [via pump P1] prior to feeding it to the mixing column. Vapor is supplied to the bottom of the mixing column as stream [14]. The oxygen-rich liquid and the vapor feed are mixed within the mixing column to produce an oxygen-rich product gas [60] that is withdrawn from the top of the mixing column and a crude liquid oxygen stream [90] that is withdrawn from the bottom of the mixing column.

If a second oxygen-rich gaseous product is desired in FIG. 1, the inclusion of stream [70] is an example of how FIG. 1's prior art process might be modified to accomplish the production of a second oxygen-rich gaseous product. The use of a single liquid reflux stream [50] however limits the ability of prior art processes to efficiently produce two different oxygen-rich gaseous products that have differing oxygen purities. This shortcoming is especially apparent when the purity of at least one of the products exceeds approximately 97 mole % oxygen.

The shortcomings of prior art processes for the production of multiple oxygen-rich gaseous products are overcome by the present invention. The present invention is able to produce at least two oxygen-rich gaseous products from a process employing a mixing column by withdrawing at least two liquid oxygen-rich streams from the distillation column system which are subsequently used as separate feeds to the mixing column system.

Before continuing, it should be noted that the distillation column system [DCS] used in FIG. 1, and indeed all the figures, comprises the typical dual column arrangement wherein a higher pressure column [DC1] is thermally linked with a lower pressure column [DC2]. This is just one example of many distillation column systems that could be used. In this arrangement, and with reference to FIG. 1, at least a portion [12] of the air feed is fed to the bottom of the higher pressure column. A primary crude liquid oxygen stream [30] is removed from the bottom of the higher pressure column, reduced in pressure [across valve V1] and fed to an intermediate location in the lower pressure column. A nitrogen-enriched overhead [20] from the higher pressure column is condensed in a primary reboiler/condenser [R/C 1] located in the bottom of the lower pressure column to produce a nitrogen-enriched liquid. A first part [22] of the nitrogen-enriched liquid is fed as reflux to an upper location in the higher pressure column while a second part [24] is reduced in pressure [across valve V2] and fed as reflux to an upper location in the lower pressure column. A nitrogen-rich stream [40] is removed as a gas from the top of the lower pressure column.

In its most general terms, and with reference to each of FIGS. 2 through 5, the present invention comprises the steps of:

(a) feeding at least a first portion [12] of the air feed to a distillation column system [DCS] comprising at least one distillation column to produce effluent streams from the distillation column system comprising a nitrogen-rich stream [40] and two oxygen-rich liquid streams having different oxygen purities [50][52]; and (b) feeding the two oxygen-rich liquid streams to a mixing column system comprising at least one mixing column [MC1] having an upward vapor flow [14] from its bottom to produce effluent streams from the mixing column system comprising a crude oxygen stream [90] and at least two oxygen-rich gaseous streams [60][70].

Figure 2:
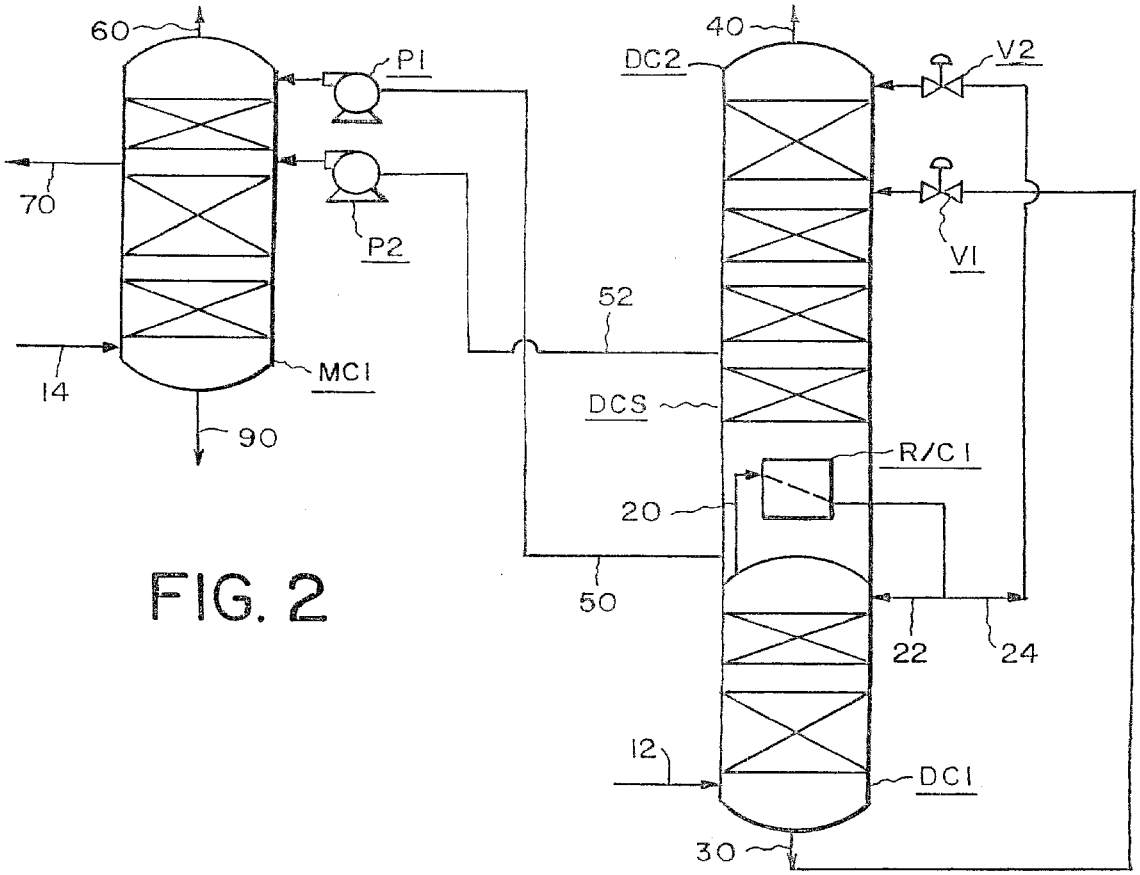
FIG. 2 is a schematic drawing of one embodiment of the present invention.

FIG. 2 shows a basic embodiment of the present invention employing a single mixing column [MC1]. It is identical to FIG. 1 (common elements use the same identification) except that to facilitate production of the second oxygen-rich gaseous product [70], a second oxygen-rich liquid stream [52] is also removed from the lower pressure column and fed to the mixing column. If the desired delivery pressure of the oxygen-rich gaseous product streams is higher than the pressure of the lower pressure column, the liquid streams are appropriately pumped [via pump P2] prior to feeding them to the mixing column. (Conversely, if the desired delivery pressure of the oxygen-rich gaseous product streams is lower than the pressure of the lower pressure column, the liquid streams are appropriately expanded prior to feeding them to the mixing column. Typically, however, the mixing column will operate at a pressure equal to or greater than the pressure of the lower pressure column.) Referring further to FIG. 2:

(i) the process produces two oxygen-rich liquid streams from the distillation column system, an oxygen-rich stream of higher oxygen purity [50] which is fed to an upper location in the mixing column (typically the top of the mixing column as shown in FIG. 2) and an oxygen-rich stream of lower oxygen purity [52] which is fed to the mixing column at a location which is at least one separation stage above the bottom of the mixing column and at least one separation stage below the feed location of the oxygen-rich liquid stream of higher oxygen purity [50];

(ii) the process produces two oxygen-rich gaseous streams from the mixing column, an oxygen-rich gaseous stream of higher oxygen purity [60] which is removed from an upper location in the mixing column (typically the top of the mixing column as shown in FIG. 2) and an oxygen-rich gaseous stream of lower oxygen purity [70] which is removed from the mixing column at least one separation stage below the removal location of oxygen-rich gaseous stream of higher oxygen purity [60] (this location may be the same as or different than the feed location of the oxygen-rich liquid stream of lower oxygen purity [52]); and (iii) the crude oxygen stream [90] is removed from a lower location in the mixing column (typically as a liquid from the bottom of the mixing column as shown in FIG. 2).

Figure 3:
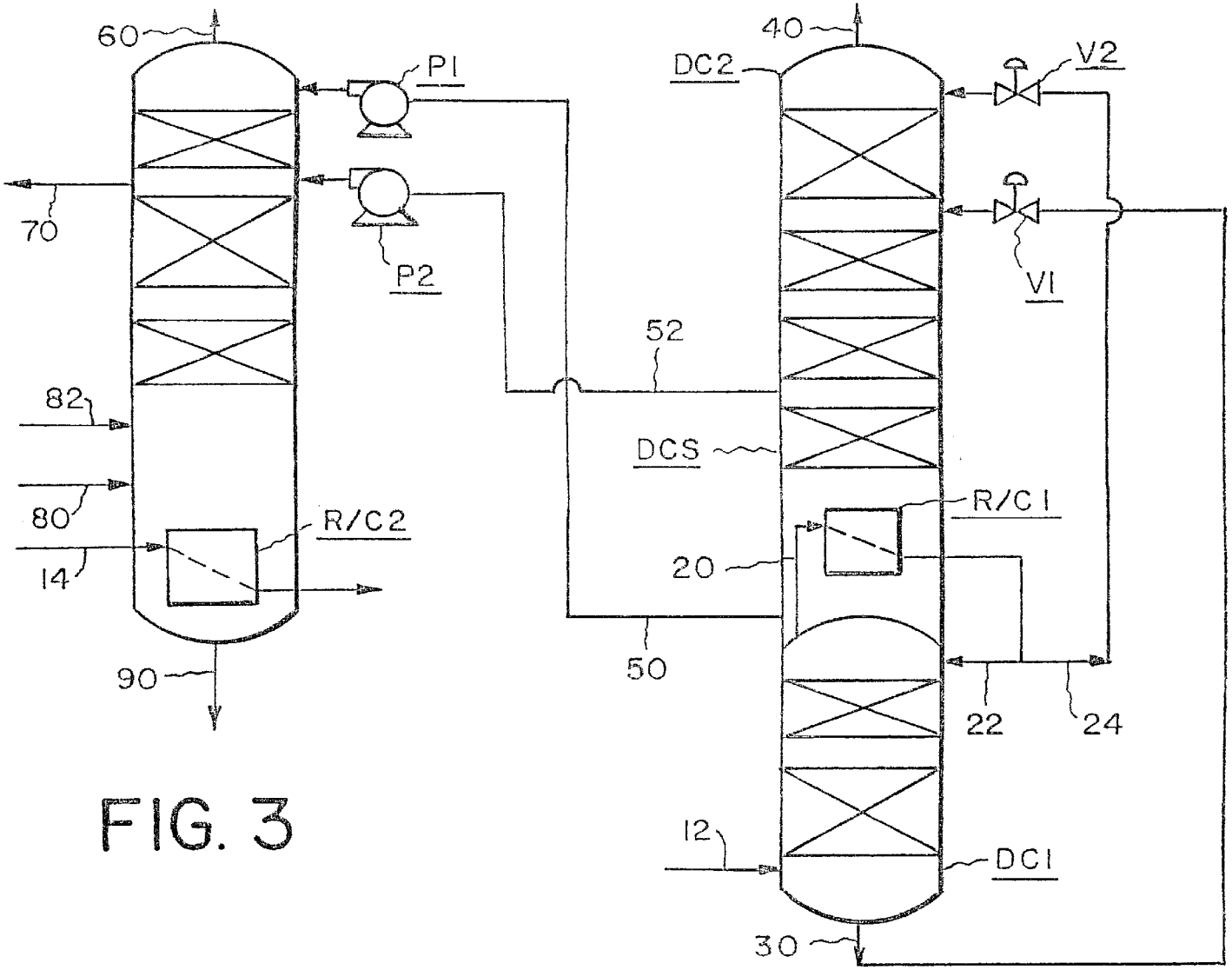
FIG. 3 is a schematic drawing of a second embodiment of the present invention.

In FIG. 2, the required upward vapor flow in the mixing column of the present invention is created by feeding any at least partially gaseous stream [14] to the bottom of the mixing column. Typically, this will consist of a portion of the air feed that has been compressed to the pressure of the mixing column and cooled to a temperature near its dew point. As one alternative and as shown in FIG. 3, at least part of the vapor flow could be created by employing an auxiliary reboiler/condenser [R/C 2] rather than by direct introduction of vapor into the mixing column. This reboiler/condenser may be located within the mixing column itself as shown in FIG. 3 or may optionally be located in another process vessel. An at least partially gaseous process stream [14] (for example, a portion of the air feed) is at least partially further condensed in the reboiler/condenser [R/C 2] by indirect heat exchange with liquid at the bottom of the mixing column. The liquid is at least partially vaporized by this indirect heat exchange process, thereby creating the required upward vapor flow. It is important to note that when a reboiler/condenser is used to create the required upward vapor flow, a liquid process stream [80] and/or a gaseous process stream [82] must also be fed to the bottom of the mixing column as shown in FIG. 3 in order to maintain proper operation of the mixing column. In this scenario, the nitrogen concentration of streams [80] and/or [82] must be greater than the nitrogen concentration of the oxygen-rich liquid stream of higher oxygen purity [50]. Preferably, the composition of streams [80] and/or [82] is such that the nitrogen concentration of the vapor rising to the bottom layer of mixing means within the mixing column is greater than the nitrogen concentration of vapor in equilibrium with the liquid descending from that same layer of mixing means. FIG. 3 is otherwise identical to FIG. 2 (common elements use the same identification).

It is important to note that the distillation column system [DCS] in the present invention from which the oxygen-rich liquid streams are withdrawn is not limited to the conventional dual column system shown in FIGS. 2 through 5 but could be any system that separates an air feed into effluent streams consisting of at least two oxygen-rich liquid streams and a nitrogen-rich stream. For example, the distillation column system could be a single column system, a dual column system modified for the production of argon by the addition of one or more rectification columns to the lower pressure column or a dual column system modified for the production of high purity, low pressure nitrogen gas by adding an extra separation section to the lower pressure column. If the distillation column system is composed of two or more columns, the oxygen-rich liquid streams may be withdrawn from different distillation columns. When the conventional dual column system is used, the oxygen-rich liquid stream of higher oxygen purity is typically removed from the bottom of the lower pressure column while the oxygen-rich liquid stream of lower oxygen purity is typically removed at least one separation stage above the bottom of the lower pressure column.

Figure 4:
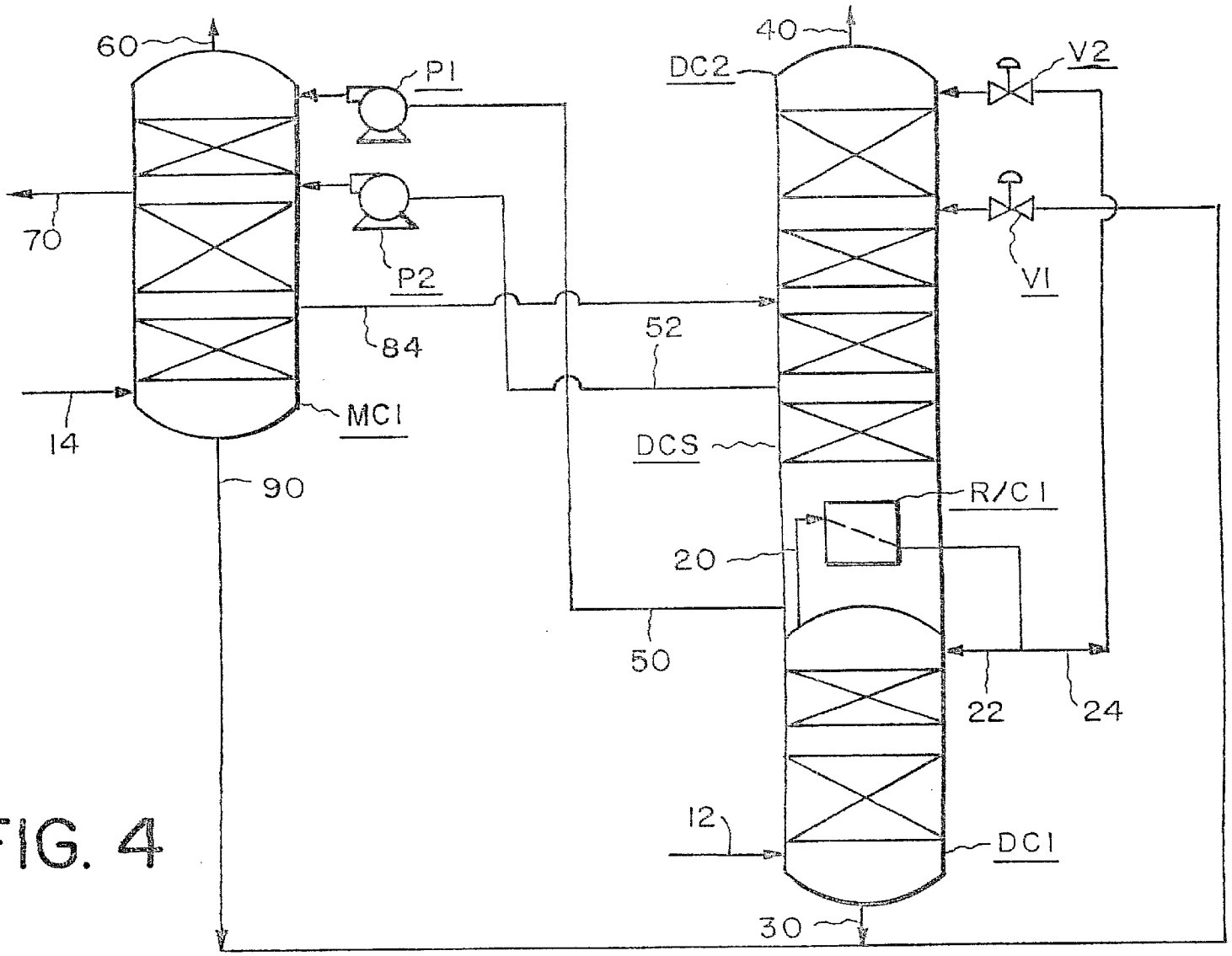
FIG. 4 is a schematic drawing of a third embodiment of the present invention.

As shown in FIG. 4, operation of FIG. 2's embodiment may be enhanced by removing a second crude liquid oxygen stream [84] from an intermediate location in the mixing column and feeding it to an intermediate location in the lower pressure column. FIG. 4 also shows how the crude liquid oxygen stream [90] from the bottom of the mixing column is optionally combined with the primary crude liquid oxygen stream [30] from the bottom of the higher pressure column. FIG. 4 is otherwise identical to FIG. 2 (common elements use the same identification).

It should be noted that the two oxygen-rich liquid streams [50] and [52] in the FIGS. 2–4 will exist in a deeply subcooled state after pumping in pumps [P1] and [P2] and prior to their introduction to the mixing column. This leads to thermodynamic inefficiency. This situation may be improved through the introduction of one or more heat exchangers that warm streams [50] and/or [52] after they are discharged from pumps [P1] and/or [P2], but prior to their introduction into the mixing column. Warming duty may be supplied by any suitable process stream, including, but not limited to, the liquid stream [90] in FIGS. 2–4 and liquid stream [84] in FIG. 4.

The two oxygen-rich liquid streams are typically removed from the lower pressure column at oxygen purities of greater than 99 mole % and less than 97 mole % respectively. This generally enables the two oxygen-rich gaseous streams to be removed from the mixing column at oxygen purities of greater than 97 mole % (preferably greater than 99 mole %) and less than 97 mole % (preferably less than 95 mole %) respectively.

Figure 5:
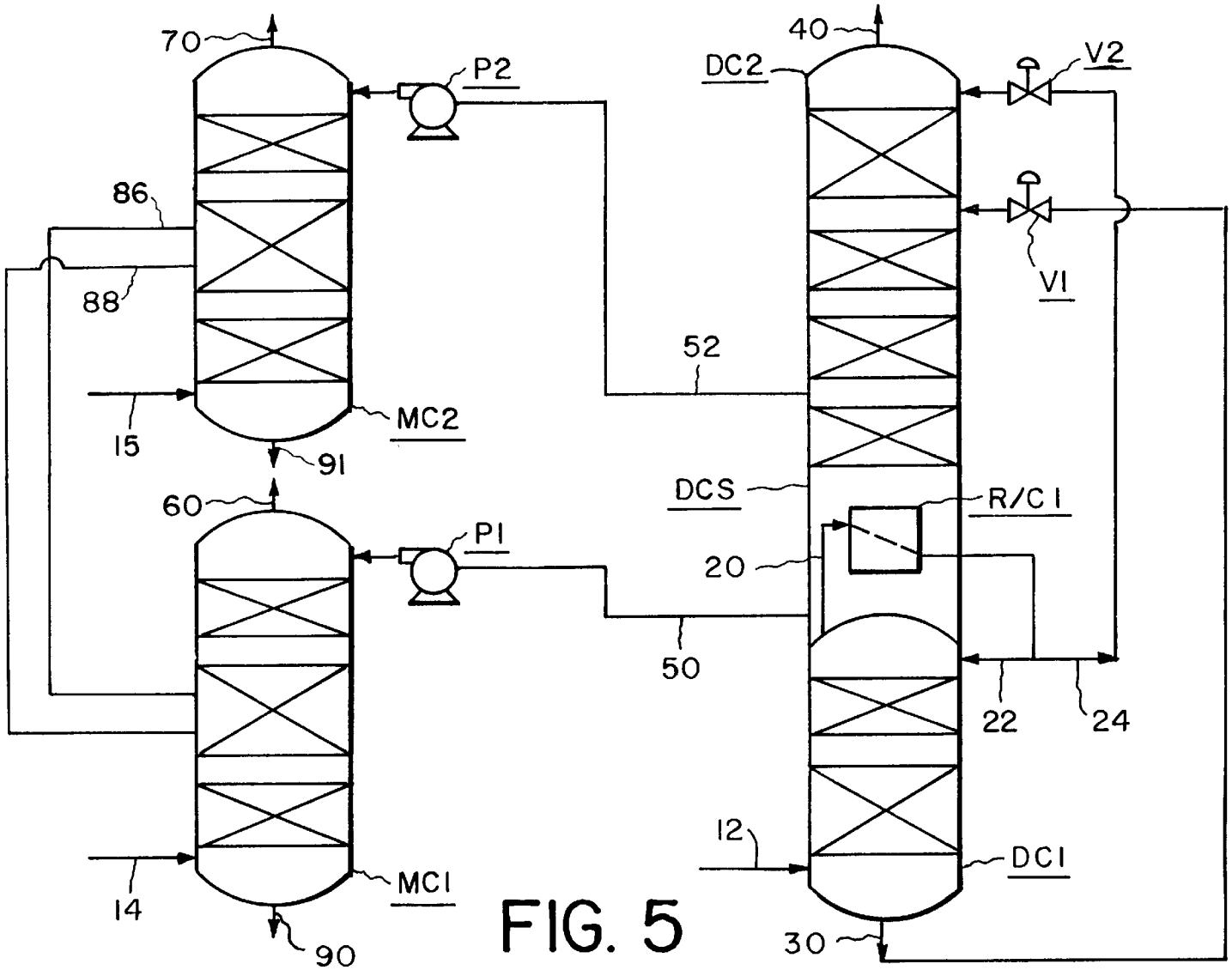
FIG. 5 is a schematic drawing of a fourth embodiment of the present invention.

FIG. 5 shows a basic embodiment of the present invention employing two mixing columns. The second mixing column [MC2], also having an upward vapor flow [15] from its bottom, is used to process the oxygen-rich liquid stream of lower oxygen purity [52] into the oxygen-rich gaseous stream of lower oxygen purity [70]. Because the two mixing columns in FIG. 5 can operate at different pressures, FIG. 5 is especially applicable where the two oxygen-rich gaseous streams are desired at different delivery pressures. Referring further to FIG. 5:

(i) the process produces two oxygen-rich liquid streams from the distillation column system, an oxygen-rich stream of higher oxygen purity [50] which is fed to the top of the first mixing column [MC1] and an oxygen-rich stream of lower oxygen purity [52] which is fed to the top of the second mixing column [MC2];

(ii) the process produces two oxygen-rich gaseous streams from the mixing column system, an oxygen-rich gaseous stream of higher oxygen purity [60] which is removed from the top of the first mixing column and an oxygen-rich gaseous stream of lower oxygen purity [70] which is removed from the top of the second mixing column; and (iii) a portion [90] of the crude liquid oxygen stream is removed from the bottom of the first column while the remaining portion [91] is removed from the bottom of the second mixing column.

As further shown in FIG. 5, operation of FIG. 5's embodiment may be enhanced by the interchange of liquid [86] or vapor [88] between the mixing columns. The magnitude and direction of flow in these streams will be determined solely by the flowrates and compositions of the oxygen-rich gaseous products produced from each mixing column. FIG. 5 is otherwise identical to FIG. 2 (common elements use the same identification).

The skilled practitioner will appreciate that the present invention can be easily adapted to the production of three or more oxygen-rich gaseous streams by simply removing three or more oxygen-rich gaseous streams from the mixing column system. Typically, but not necessarily, this would be in conjunction with the transfer of a corresponding number of oxygen-rich liquid streams from the distillation column system to the mixing column system. The multiple liquid streams could all be fed to a single mixing column or, especially where the gaseous products are required at different pressures, each liquid stream could be fed to its own mixing column.

The skilled practitioner will further appreciate that the present invention can be efficiently integrated with power generating turbine cycles such as the Coal Gasification Combined Cycle (CGCC) or direct reduction of iron ore processes. In these modes of integration, either all or a portion of feed air for the air separation plant may be withdrawn from the compressor portion of the gas turbine. This air is then cooled against any suitable medium by heat exchange and fed to the air separation unit. All or a portion of the nitrogen from the air separation unit may then be compressed and returned to a suitable location of the gas turbine. Either one or both of the gaseous oxygen streams produced from one or more mixing columns can be further compressed (if necessary) and sent to a coal gasifier to generate fuel gas for the power generation.

Finally, the skilled practitioner will appreciate that the following ordinary features of an air separation process, which have been omitted from FIGS. 2 through 5 for simplicity, can easily be incorporated by one skilled in the art.

(1) Main air compressor, front end clean-up system and main heat exchanger.

Prior to feeding the air feed to the distillation column system, the air feed is compressed in a main air compressor, cleaned of impurities which will freeze out at cryogenic temperatures (such as water and carbon dioxide) and/or other undesirable impurities (such as carbon monoxide, hydrogen and potentially dangerous organic compounds) in a front end clean-up system (typically comprising adsorbent beds) and cooled to a temperature near its dew point in a main heat exchanger against warming product streams.

(2) Refrigeration generating expander scheme.

Especially where a large quantity of liquid must be produced, it may be necessary to generate additional refrigeration in the process to complete the heat balance. This is typically accomplished by expanding at least a portion of the air feed and/or gaseous waste stream(s) and/or gaseous product stream(s). Where air expansion is employed, the expanded air is subsequently fed to an appropriate location in the distillation column system, while in the other cases, the expanded gas is subsequently warmed in the main heat exchanger against the incoming air feed. Opportunities may also exist to link the expander with a compressor in the process such that the work produced by the expander is used to drive the compressor (i.e. a compander arrangement).

(3) Subcooling heat exchangers.

Prior to reducing the pressure of the liquid streams from the higher pressure column and/or mixing column(s) and feeding them to the lower pressure column, such streams may be subcooled in one or more subcooling heat exchangers against warming gaseous streams from the lower pressure column. This type of heat integration increases the overall thermodynamic efficiency of the process.

The present invention differs from the prior art processes taught in U.S. Pat. Nos. 5,315,833 and 5,396,773 and European Patent Application Number 96301423.8 in that at least one mixing column is used to produce the oxygen-rich products. These products are typically produced using an auxiliary booster compressor, which is used to compress gaseous oxygen-rich products after they have been warmed to ambient temperature (direct compression of product oxygen-rich gas), or used to compress an inlet air stream that is then used to boil an oxygen-rich liquid stream removed from the lower sections of the lower pressure column and pumped, if necessary, to the product delivery pressure (the pumped liquid oxygen arrangement). Auxiliary compression is capital and energy intensive. The use of a mixing column can reduce the number of compression stages required in this compressor, or even eliminate the need for such a compressor entirely. In certain applications, the mixing column represents a distinct opportunity to lower capital and energy costs over prior art processes that employ such auxiliary compression.

The present invention differs most significantly from prior art processes taught in U.S. Pat. Nos. 4,022,030, 5,291,737 and 5,454,227 and European Application Number 94302954.6 in that the mixing column is fed at least two different oxygen-rich liquid streams from the distillation system. In the case where both liquids are withdrawn from the same distillation column, the sections of the distillation column located directly above the withdrawal points of these streams are then able to operate with different liquid to vapor ratios than those sections located below the withdrawal points, thus allowing a higher overall recovery of oxygen. In particular, when a computer simulation of the present invention as embodied in FIG. 4 was compared with a computer simulation of the modified prior art as embodied in a flowsheet identical to FIG. 4 except for the absence of the second oxygen-rich liquid stream [52], it was found that the oxygen recovery is 11.3% higher when 32% of the aggregate oxygen product is recovered as the higher purity oxygen product. This increase in oxygen recovery drops to 6.7% when 50% of the aggregate oxygen product is recovered as the higher purity oxygen product and to 0.5% when 75% of the aggregate oxygen product is recovered as the higher purity oxygen product. In these simulations, the two oxygen products are produced at substantially the pressure of the higher pressure column (approximately 77 psia) and at oxygen purities of approximately 99.5 mole % and 95 mole % respectively.

We claim:

1. A process for the cryogenic distillation of an air feed to produce at least two oxygen-rich gaseous streams having different oxygen purities, said process comprising the steps of:

(a) feeding at least a first portion of the air feed to a distillation column system comprising at least one distillation column to produce effluent streams from the distillation column system comprising a nitrogen-rich stream and at least two oxygen-rich liquid streams having different oxygen purities; and (b) feeding the two oxygen-rich liquid streams to a mixing column system comprising at least one mixing column having an upward vapor flow from its bottom to produce effluent streams from the mixing column system comprising a crude oxygen stream and the at least two oxygen-rich gaseous streams.

2. The process of claim 1 wherein at least part of the vapor flow at the bottom of each mixing column in the mixing column system is created by feeding a second portion of the air feed to the bottom of the mixing column.

3. The process of claim 1 wherein at least part of the vapor flow at the bottom of each mixing column in the mixing column system is created by:

(i) locating an auxiliary reboiler/condenser in the bottom of the mixing column;

(ii) at least partially further condensing an at least partially gaseous process stream in said reboiler/condenser against vaporizing liquid at the bottom of the mixing column; and (iii) feeding a liquid process stream and/or a gaseous process stream to the bottom of the mixing column wherein the nitrogen concentration of said stream(s) is greater than the nitrogen concentration of the oxygen-rich liquid stream of higher oxygen purity.

4. The process of claim 1 wherein the oxygen-rich liquid streams are pumped prior to feeding them to the mixing column system.

5. The process of claim 1 wherein the mixing column system comprises a single mixing column.

6. The process of claim 5 wherein:

(i) the process produces two oxygen-rich liquid streams from the distillation column system, an oxygen-rich stream of higher oxygen purity which is fed to the top of the mixing column and an oxygen-rich stream of lower oxygen purity which is fed to the mixing column at a location which is at least one separation stage above the bottom of the mixing column and at least one separation stage below the feed location of the oxygen-rich liquid stream of higher oxygen purity;

(ii) the process produces two oxygen-rich gaseous streams from the mixing column, an oxygen-rich gaseous stream of higher oxygen purity which is removed from the top of the mixing column and an oxygen-rich gaseous stream of lower oxygen purity which is removed from the mixing column at least one separation stage below the removal location of oxygen-rich gaseous stream of higher oxygen purity; and (iii) the crude oxygen stream is removed as a liquid from the bottom of the mixing column.

7. The process of claim 6 wherein:

(i) the distillation column system comprises a higher pressure column and a lower pressure column;

(ii) the air feed is more specifically fed to the bottom of the higher pressure column;

(iii) a primary crude liquid oxygen stream is removed from the bottom of the higher pressure column, reduced in pressure and fed to an intermediate location in the lower pressure column;

(iv) a nitrogen-enriched overhead from the higher pressure column is condensed in a primary reboiler/condenser located in the bottom of the lower pressure column to produce a nitrogen-enriched liquid, a first part thereof is fed as reflux to an upper location in the higher pressure column and a second part thereof is reduced in pressure and fed as reflux to an upper location in the lower pressure column; and (v) the nitrogen-rich stream is removed as a gas from the top of the lower pressure column.

8. The process of claim 7 wherein the oxygen-rich liquid stream of higher oxygen purity is removed from the bottom of the lower pressure column while the oxygen-rich liquid stream of lower oxygen purity is removed at least one separation stage above the bottom of the lower pressure column.

9. The process of claim 7 wherein a second crude liquid oxygen stream is removed from an intermediate location in the mixing column and fed to an intermediate location in the lower pressure column.

10. The process of claim 7 wherein the crude liquid oxygen stream from the bottom of the mixing column is combined with the primary crude liquid oxygen stream from the bottom of the higher pressure column.

11. The process of claim 6 wherein:

(i) the oxygen purity of the oxygen-rich liquid stream of higher oxygen purity is greater than 99 mole % while the oxygen purity of the oxygen-rich liquid stream of lower oxygen purity is less than 97 mole %; and (ii) the oxygen purity of the oxygen-rich gaseous stream of higher oxygen purity is greater than 97 mole % while the oxygen purity of the oxygen-rich gaseous stream of lower oxygen purity is less than 97 mole %.

12. The process of claim 1 wherein the mixing column system comprises a first mixing column and a second mixing column, each having an upward vapor flow from its bottom.

13. The process of claim 12 wherein:

(i) the process produces two oxygen-rich liquid streams from the distillation column system, an oxygen-rich stream of higher oxygen purity which is fed to the top of the first mixing column and an oxygen-rich stream of lower oxygen purity which is fed to the top of the second mixing column;

(ii) the process produces two oxygen-rich gaseous streams from the mixing column system, an oxygen-rich gaseous stream of higher oxygen purity which is removed from the top of the first mixing column and an oxygen-rich gaseous stream of lower oxygen purity which is removed from the top of the second mixing column; and (iii) a portion of the crude liquid oxygen stream is removed from the bottom of the first column while the remaining portion is removed from the bottom of the second mixing column.

14. The process of claim 13 wherein the first and second mixing columns operate at different pressures such that the two oxygen-rich gaseous streams are produced at different pressures.

15. The process of claim 12 wherein there is an interchange of vapor and/or liquid between the first and second mixing columns.

16. The process of claim 1 wherein three or more oxygen-rich liquid streams are transferred from the distillation column system to the mixing column system and wherein three or more oxygen-rich gaseous streams are produced from the mixing column system.

* * * * *